US010392945B2

(12) United States Patent
Dutta et al.

(10) Patent No.: US 10,392,945 B2
(45) Date of Patent: Aug. 27, 2019

(54) TURBOMACHINE COOLING SYSTEM

(71) Applicant: General Electric Company, Schenectady, NY (US)

(72) Inventors: Sandip Dutta, Greenville, SC (US); Scott Francis Johnson, Simpsonville, SC (US); Joseph Anthony Weber, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 231 days.

(21) Appl. No.: 15/599,912

(22) Filed: May 19, 2017

(65) Prior Publication Data

US 2018/0334910 A1 Nov. 22, 2018

(51) Int. Cl.
*F01D 5/18* (2006.01)
*F01D 5/14* (2006.01)

(52) U.S. Cl.
CPC ..... *F01D 5/189* (2013.01); *F01D 5/147* (2013.01); *F01D 5/187* (2013.01); *F01D 5/188* (2013.01); *F05D 2250/184* (2013.01); *F05D 2260/20* (2013.01); *F05D 2260/201* (2013.01); *F05D 2260/202* (2013.01); *F05D 2260/2214* (2013.01); *F05D 2260/38* (2013.01)

(58) Field of Classification Search
CPC ..... F01D 5/188; F01D 5/189; F01D 5/186; F01D 5/187
USPC ..... 415/115; 416/97 R
See application file for complete search history.

(56) References Cited

U.S. PATENT DOCUMENTS 2,994,124 A * 8/1961 Denny ..... B22F 7/04 415/217.1
3,836,282 A * 9/1974 Mandelbaum ..... F01D 9/042 415/209.4
4,519,745 A * 5/1985 Rosman ..... F01D 5/284 416/241 B
8,079,821 B2 12/2011 Campbell
8,292,580 B2 * 10/2012 Schiavo ..... F01D 5/189 416/229 A
8,777,569 B1 * 7/2014 Liang ..... F01D 5/188 416/96 A
9,528,382 B2 * 12/2016 Morgan ..... F01D 5/147
(Continued)

FOREIGN PATENT DOCUMENTS

GB 2084262 A 4/1982
WO WO-2017123207 A1 * 7/2017 ..... F01D 5/188

OTHER PUBLICATIONS

U.S. Appl. No. 14/974,460, filed Dec. 18, 2015.
U.S. Appl. No. 15/016,498, filed Feb. 5, 2016.
U.S. Appl. No. 15/364,710, filed Nov. 30, 2016.

*Primary Examiner* — Carlos A Rivera
*Assistant Examiner* — Behnoush Haghighian
(74) *Attorney, Agent, or Firm* — Dority & Manning, P.A.

(57) ABSTRACT

The present disclosure is directed to a cooling system for a turbomachine. The cooling system includes a turbomachine component defining a turbomachine component cavity. The cooling system also includes an insert positioned within the turbomachine component cavity for cooling the turbomachine component. The insert includes an insert body and a spring body. The spring body includes a first portion fixedly coupled to the insert body, a second portion in sliding engagement with the turbomachine component, and a third portion in sliding engagement with the insert body.

20 Claims, 7 Drawing Sheets

(56) References Cited

U.S. PATENT DOCUMENTS

| | | | | |
|---|---|---|---|---|
| 2011/0110790 | A1* | 5/2011 | Itzel | F01D 5/147 416/97 R |
| 2016/0348536 | A1 | 12/2016 | Lacy et al. | |
| 2017/0067636 | A1 | 3/2017 | Lacy et al. | |
| 2017/0067699 | A1 | 3/2017 | Lacy et al. | |

* cited by examiner

TURBOMACHINE COOLING SYSTEM

FIELD

The present disclosure generally relates to turbomachines. More particularly, the present disclosure relates to cooling systems for turbomachines.

BACKGROUND

A gas turbine engine generally includes a compressor section, a combustion section, and a turbine section. The compressor section progressively increases the pressure of air entering the gas turbine engine and supplies this compressed air to the combustion section. The compressed air and a fuel (e.g., natural gas) mix within the combustion section. This mixture burns within a combustion chamber to generate high pressure and high temperature combustion gases. The combustion gases flow from the combustion section into the turbine section where they expand to produce work. For example, expansion of the combustion gases in the turbine section may rotate a rotor shaft connected to a generator to produce electricity.

The turbine section includes one or more turbine nozzles, which direct the flow of combustion gases onto one or more turbine rotor blades. The one or more turbine rotor blades, in turn, extract kinetic energy and/or thermal energy from the combustion gases, thereby driving the rotor shaft. In general, each turbine nozzle includes an inner side wall, an outer side wall, and one or more airfoils extending between the inner and the outer side walls. Since the one or more airfoils are in direct contact with the combustion gases, it may be necessary to cool the airfoils.

In certain configurations, cooling air is routed through one or more inner cavities defined by the turbine nozzles. Typically, this cooling air is compressed air bled from the compressor section. Bleeding air from the compressor section, however, reduces the volume of compressed air available for combustion, thereby reducing the efficiency of the gas turbine engine.

BRIEF DESCRIPTION

Aspects and advantages of the technology will be set forth in part in the following description, or may be obvious from the description, or may be learned through practice of the technology.

In one embodiment, the present disclosure is directed to a cooling system for a turbomachine. The cooling system includes a turbomachine component defining a turbomachine component cavity. The cooling system also includes an insert positioned within the turbomachine component cavity for cooling the turbomachine component. The insert includes an insert body and a spring body. The spring body conducts heat from the turbomachine component to the insert body. The spring body includes a first portion fixedly coupled to the insert body, a second portion in sliding engagement with the turbomachine component, and a third portion in sliding engagement with the insert body.

In another embodiment, the present disclosure is directed to a turbomachine. The turbomachine includes a turbine section having a turbine section component defining a turbine section component cavity. An insert is positioned within the turbine section component cavity for cooling the turbomachine component. The insert includes an insert body and a spring body. The spring body conducts heat from the turbomachine component to the insert body. The spring body includes a first portion fixedly coupled to the insert body, a second portion in sliding engagement with the turbomachine component, and a third portion in sliding engagement with the insert body.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which:

FIG. 1 is a schematic view of an exemplary gas turbine engine in accordance with embodiments of the present disclosure;

Figure 7:
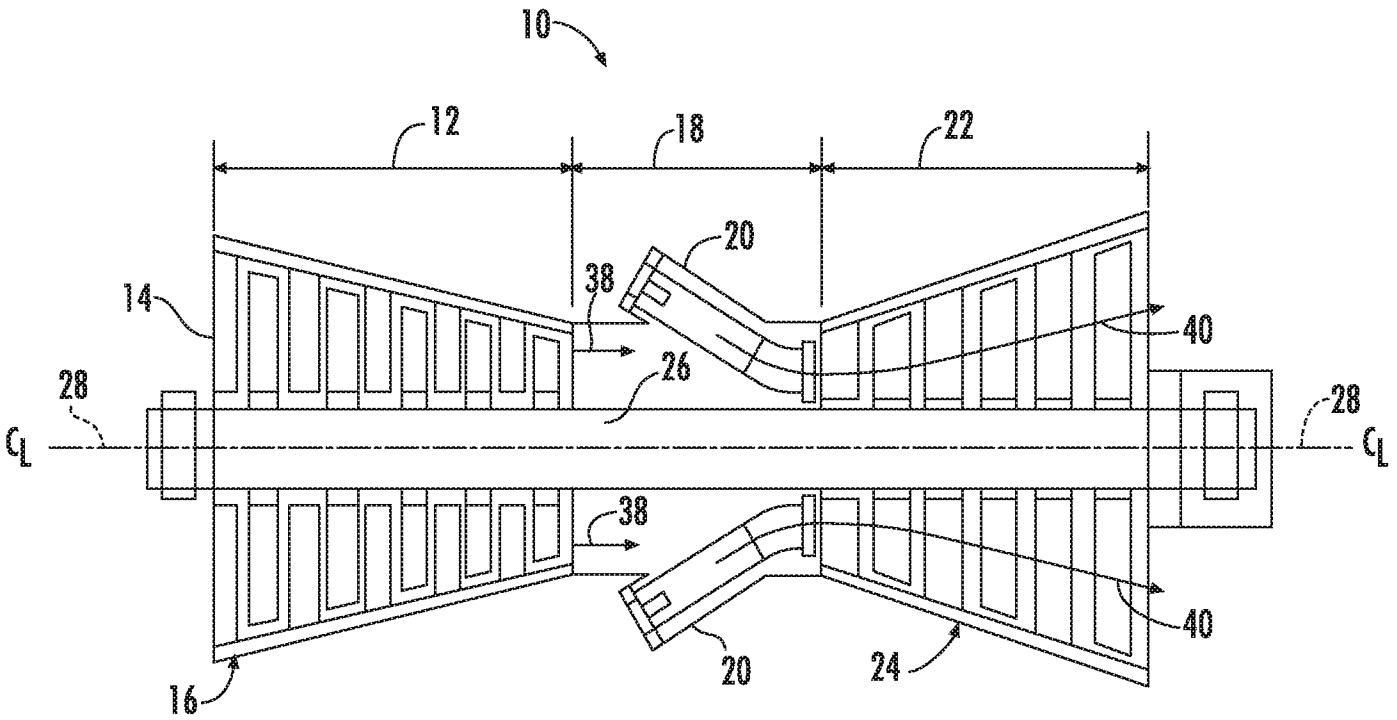
FIG. 7 is a cross-sectional view of an embodiment of a spring body in accordance with embodiments of the present disclosure.

Repeat use of reference characters in the present specification and drawings is intended to represent the same or analogous features or elements of the present technology.

DETAILED DESCRIPTION

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents.

Although an industrial or land-based gas turbine engine is shown and described herein, the present technology as shown and described herein is not limited to a land-based and/or industrial gas turbine unless otherwise specified in the claims. For example, the technology as described herein may be used in any type of turbomachine including, but not limited to, aviation gas turbines (e.g., turbofans, etc.), steam turbines, and marine gas turbines.

Referring now to the drawings, FIG. 1 is a schematic of an exemplary gas turbine engine 10. As shown, the gas turbine engine 10 generally includes a compressor section 12 having an inlet 14 disposed at an upstream end of a compressor 16 (e.g., an axial compressor). The gas turbine engine 10 further includes a combustion section 18 having one or more combustors 20 positioned downstream from the compressor 16. The gas turbine engine 10 also includes a turbine section 22 having a turbine 24 (e.g., an expansion turbine) disposed downstream from the combustion section 18. A shaft 26 extends axially through the compressor 16 and the turbine 24 along an axial centerline 28 of the gas turbine engine 10.

Figure 2:
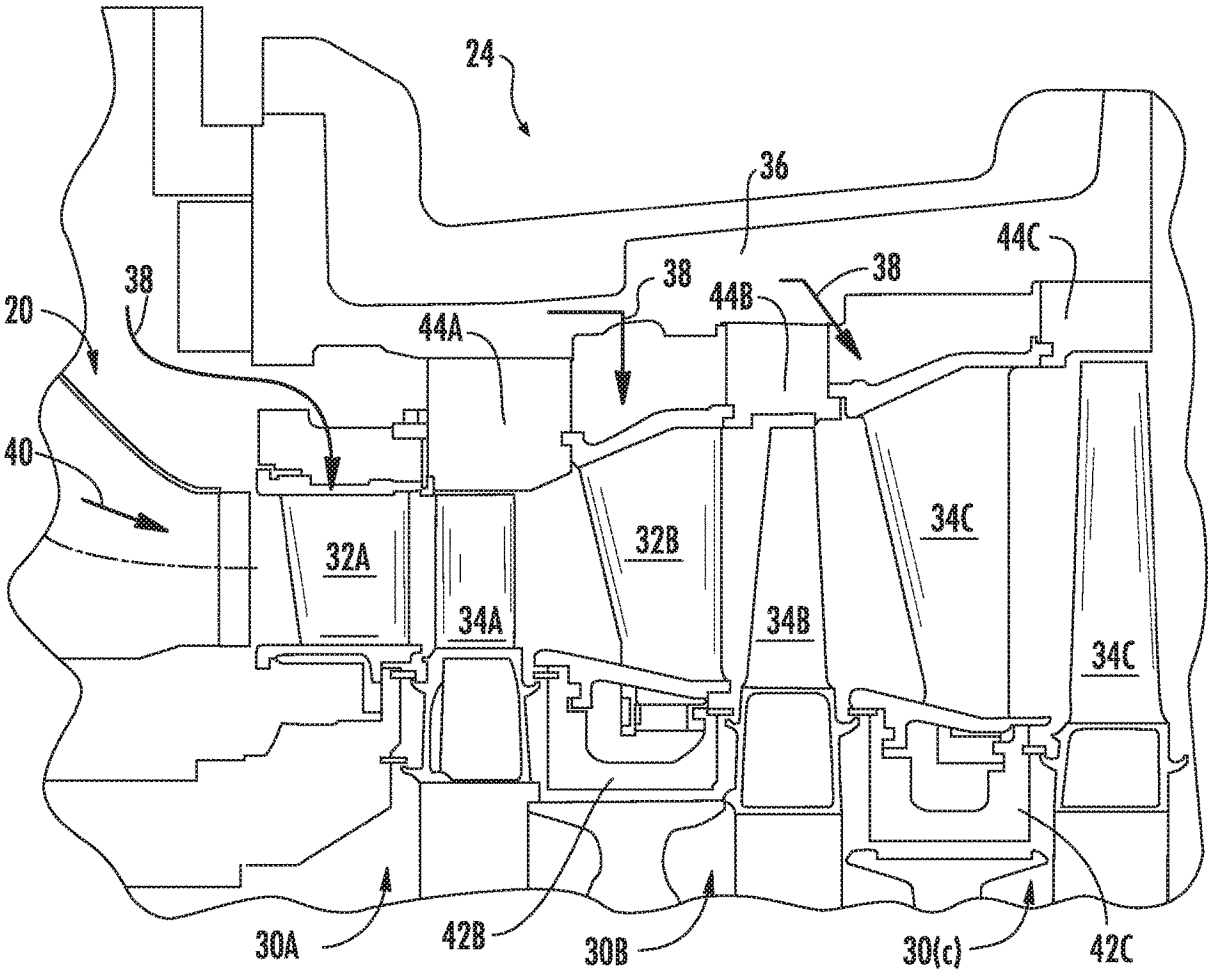
FIG. 2 is a cross-sectional view of an exemplary turbine section in accordance with embodiments of the present disclosure.

FIG. 2 is a cross-sectional side view of the turbine 24. As shown, the turbine 24 may include multiple turbine stages. For example, the turbine 24 may include a first stage 30A, a second stage 30B, and a third stage 30C. Although, the turbine 24 may include more or less turbine stages in other embodiments.

Each stage 30A-30C includes, in serial flow order, a corresponding row of turbine nozzles 32A, 32B, and 32C and a corresponding row of turbine rotor blades 34A, 34B, and 34C axially spaced apart along the rotor shaft 26 (FIG. 1). Each of the turbine nozzles 32A-32C remains stationary during operation of the gas turbine engine 10. The rows of turbine nozzles 32B, 32C are respectively coupled to a corresponding diaphragm 42B, 42C. Although not shown in FIG. 2, the row of turbine nozzles 32A may also couple to a corresponding diaphragm. A first turbine shroud 44A, a second turbine shroud 44B, and a third turbine shroud 44C circumferentially enclose the corresponding row of turbine blades 34A-34C. A casing or shell 36 circumferentially surrounds each stage 30A-30C of the turbine nozzles 32A-32C and the turbine rotor blades 34A-34C.

As illustrated in FIGS. 1 and 2, the compressor 16 provides compressed air 38 to the combustors 20. The compressed air 38 mixes with fuel (e.g., natural gas) in the combustors 20 and burns to create combustion gases 40, which flow into the turbine 24. The turbine nozzles 32A-32C direct the combustion gases onto the turbine rotor blades 34A-34C, which extract kinetic and/or thermal energy from the combustion gases 40. This energy extraction drives the rotor shaft 26. The combustion gases 40 then exit the turbine 24 and the gas turbine engine 10. As will be discussed in greater detail below, a portion of the compressed air 38 may be used as a cooling medium for cooling the various components of the turbine 24, such as the turbine nozzles 32A-32C.

Figure 3:
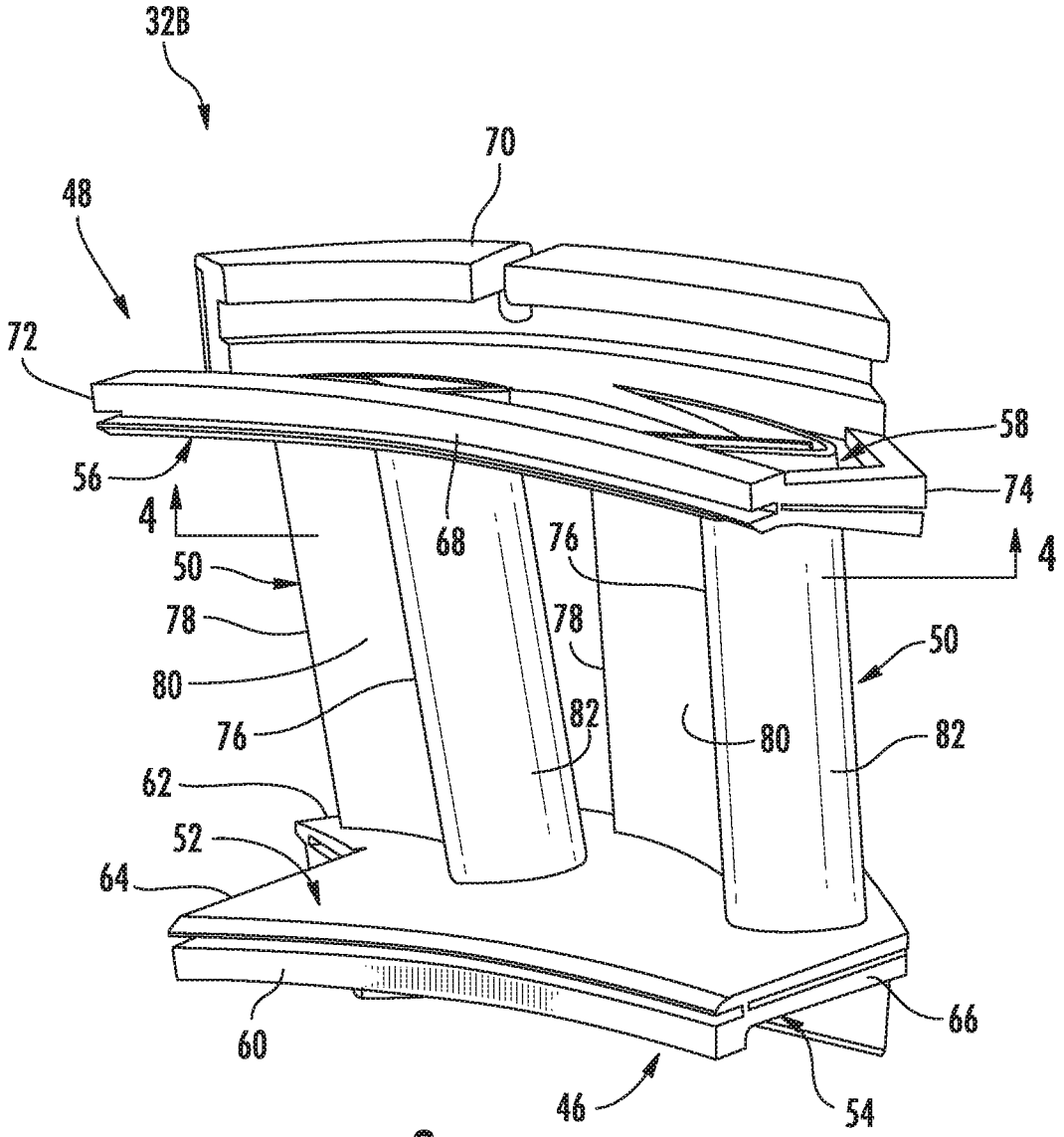
FIG. 3 is a perspective view of an exemplary nozzle in accordance with embodiments of the present disclosure.

FIG. 3 is a perspective view of the turbine nozzle 32B of the second stage 30B, which may also be known in the industry as the stage two nozzle or S2N. The other turbine nozzles 32A, 32C include features similar to those of the turbine nozzle 32B. As shown in FIG. 3, the turbine nozzle 32B includes an inner side wall 46 and an outer side wall 48 radially spaced apart from the inner side wall 46. A pair of airfoils 50 extends in span from the inner side wall 46 to the outer side wall 48. In this respect, the turbine nozzle 32B illustrated in FIG. 3 is referred to in the industry as a doublet. Nevertheless, the turbine nozzle 32B may have only one airfoil 50 (i.e., a singlet), three airfoils 50 (i.e., a triplet), or more airfoils 50.

As illustrated in FIG. 3, the inner and the outer side walls 46, 48 include various surfaces. More specifically, the inner side wall 46 includes a radially outer surface 52 and a radially inner surface 54 positioned radially inward from the radially outer surface 52. Similarly, the outer side wall 48 includes a radially inner surface 56 and a radially outer surface 58 oriented radially outward from the radially inner surface 56. As shown in FIGS. 2 and 3, the radially inner surface 56 of the outer side wall 48 and the radially outer surface 52 of the inner side wall 46 respectively define the inner and outer radial flow boundaries for the combustion gases 40 flowing through the turbine 24. The inner side wall 46 also includes a forward surface 60 and an aft surface 62 positioned downstream from the forward surface 60. The inner side wall 46 further includes a first circumferential surface 64 and a second circumferential surface 66 circumferentially spaced apart from the first circumferential surface 64. Similarly, the outer side wall 48 includes a forward surface 68 and an aft surface 70 positioned downstream from the forward surface 68. The outer side wall 48 also includes a first circumferential surface 72 and a second circumferential surface 74 spaced apart from the first circumferential surface 72.

Figure 4:
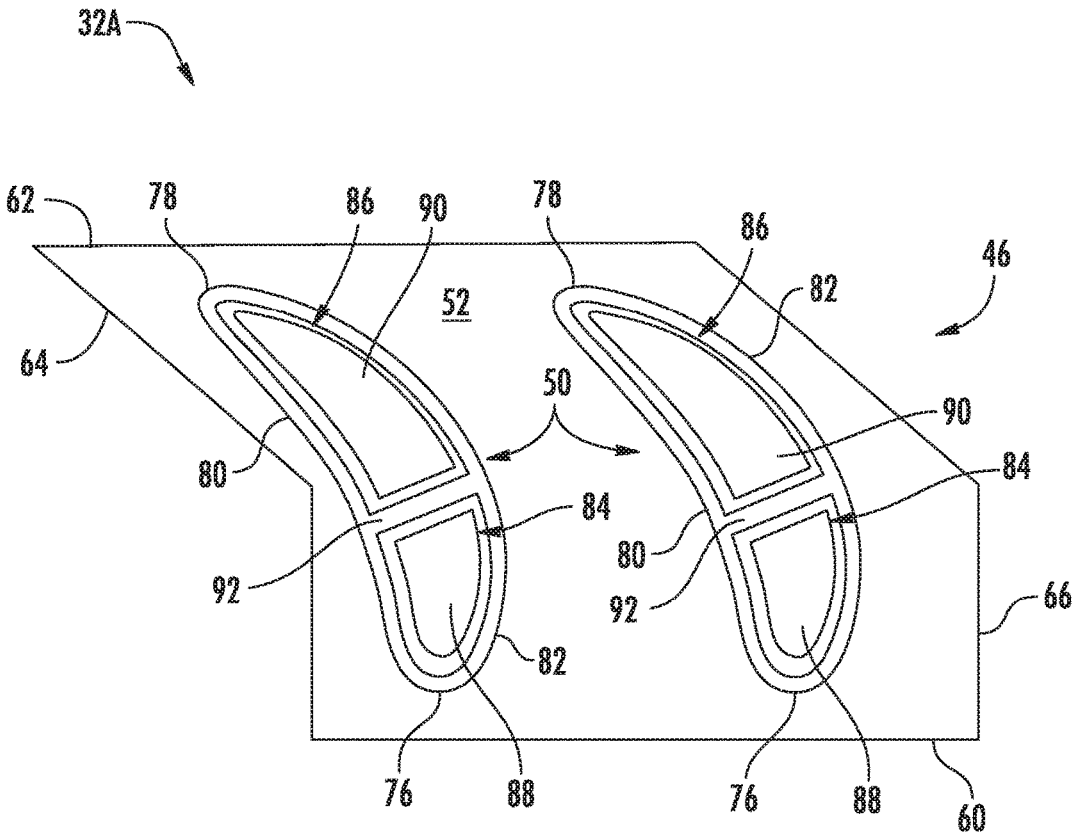
FIG. 4 is a cross-sectional view of the nozzle taken generally about line 4-4 in FIG. 3 in accordance with embodiments of the present disclosure.

As mentioned above, two airfoils 50 extend from the inner side wall 46 to the outer side wall 48. As illustrated in FIGS. 3 and 4, each airfoil 50 includes a leading edge 76 disposed proximate to the forward surfaces 60, 68 of the inner and the outer side walls 46, 48. Each airfoil 50 also includes a trailing edge 78 disposed proximate to the aft surfaces 62, 70 of the inner and the outer side walls 46, 48. Furthermore, each airfoil 50 includes a pressure side wall 80 and an opposing suction side wall 82 extending from the leading edge 76 to the trailing edge 78.

Each airfoil 50 may define one or more inner cavities therein. An insert may be positioned in each of the inner cavities to provide the compressed air 38 (e.g., via impingement cooling) to the pressure-side and suction-side walls 80, 82 of the airfoil 50. In the embodiment illustrated in FIG. 4, each airfoil 50 defines a forward inner cavity 84 having a forward insert 88 positioned therein and an aft inner cavity 86 having an aft insert 90 positioned therein. A rib 92 may separate the forward and aft inner cavities 84, 86. Nevertheless, the airfoils 50 may define one inner cavity, three inner cavities, or four or more inner cavities in alternate embodiments. Furthermore, some or all of the inner cavities may not include inserts in certain embodiments.

FIGS. 5-9 illustrate various embodiments of a cooling system 100 for a turbomachine, such as the gas turbine engine 10. As shown, the cooling system 100 defines an axial direction A, a radial direction R, and a circumferential direction C. In general, the axial direction A extends parallel to an axial centerline 28, the radial direction R extends orthogonally outward from the axial centerline 28, and the circumferential direction C extends concentrically around the axial centerline 28.

The cooling system 100 includes an insert 104 positioned within a turbomachine cavity 106 of a turbomachine component 108. In some embodiments, for example, the insert 104 may be positioned in one of the forward or aft inner cavities 84, 86 in the nozzle 32B in place of the corresponding forward or aft insert 88, 90 shown in FIG. 4. In this respect, the turbomachine component cavity 106 may be one of the forward or aft inner cavities 84, 86 and turbomachine component 108 may be the nozzle 32B. In further embodiments, however, the turbomachine component 108 may be one of the other nozzles 32A, 38C, one of the turbine shrouds 44A-44C, or one of the rotor blades 32A-32C. In such embodiments, the turbomachine component cavity 106 may be any suitable cavity defined by one of these components. Nevertheless, the turbomachine component 108 may be any suitable component of the gas turbine engine 10.

The turbomachine component 104 is shown generically in FIGS. 5-9 as having an annular cross-section. Nevertheless, the turbomachine component 104 may have any suitable cross-section and/or shape.

Figure 5:
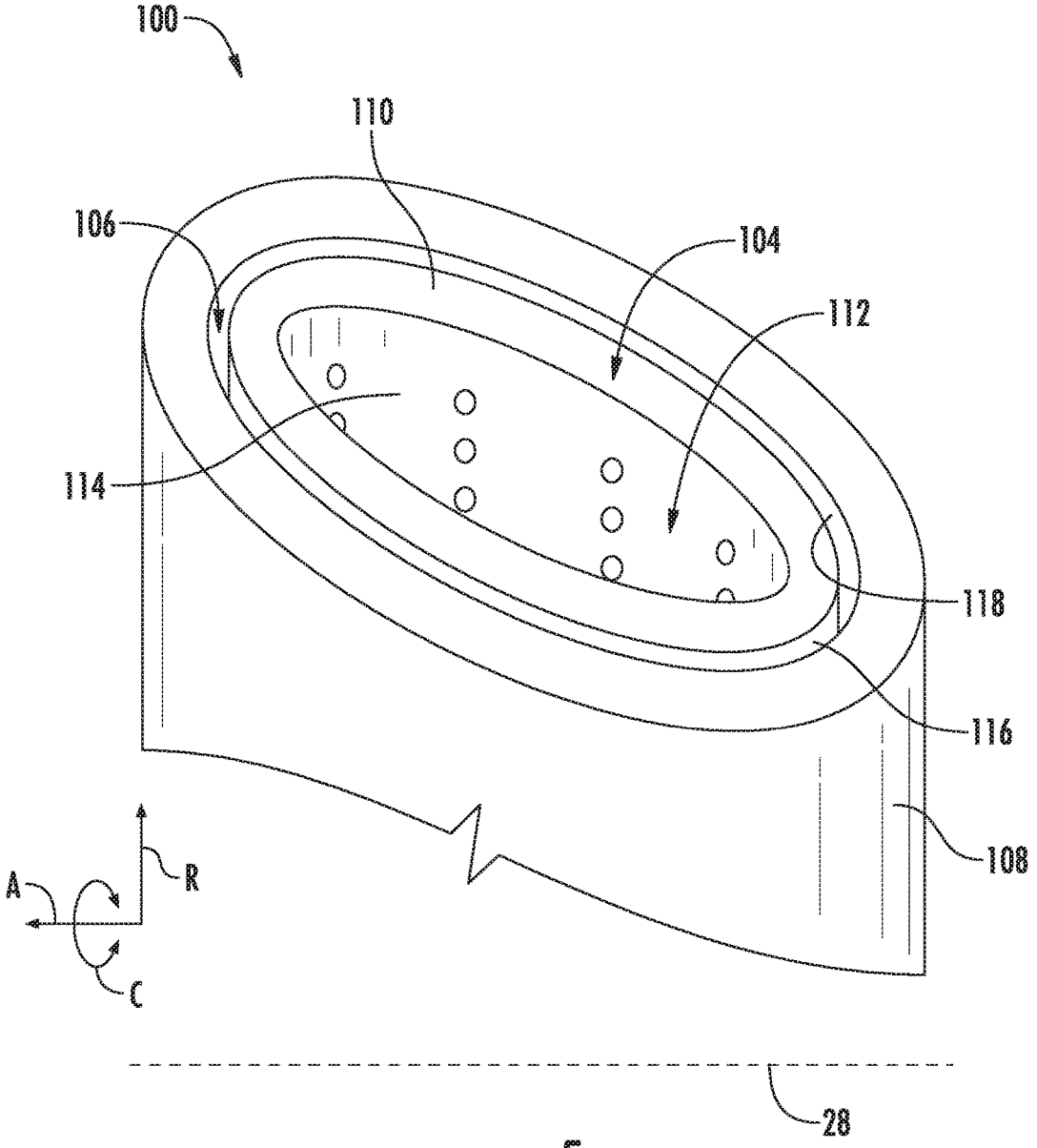
FIG. 5 is a perspective view of a cooling system in accordance with embodiments of the present disclosure.
Figure 6:
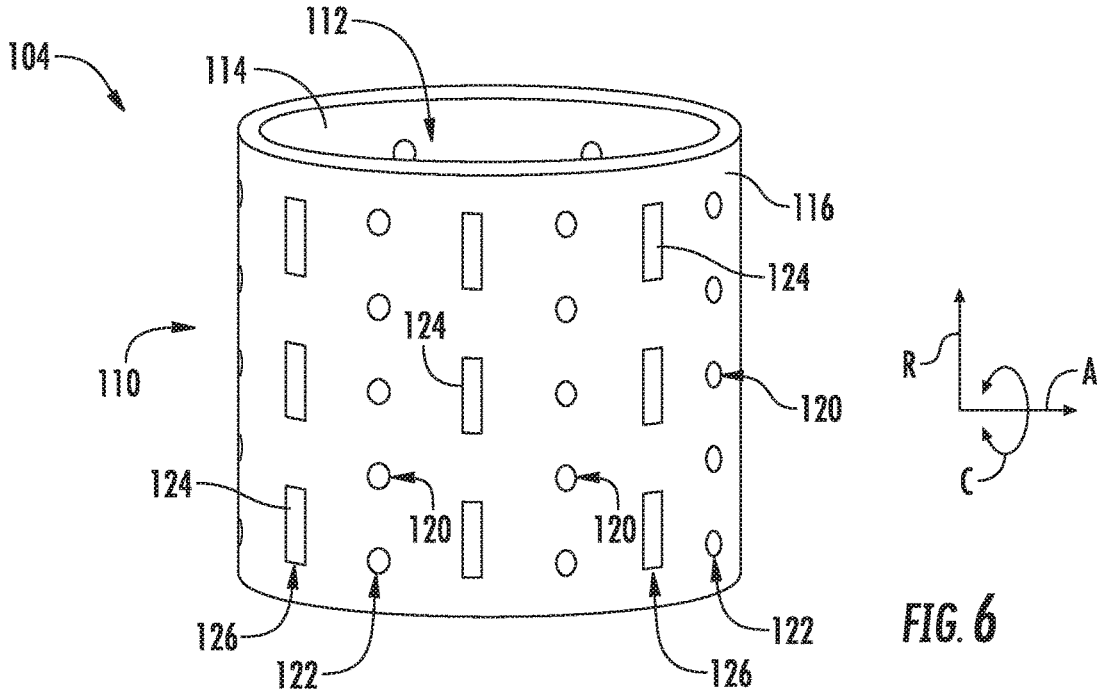
FIG. 6 is a front view of an insert in accordance with embodiments of the present disclosure.
Figure 7:
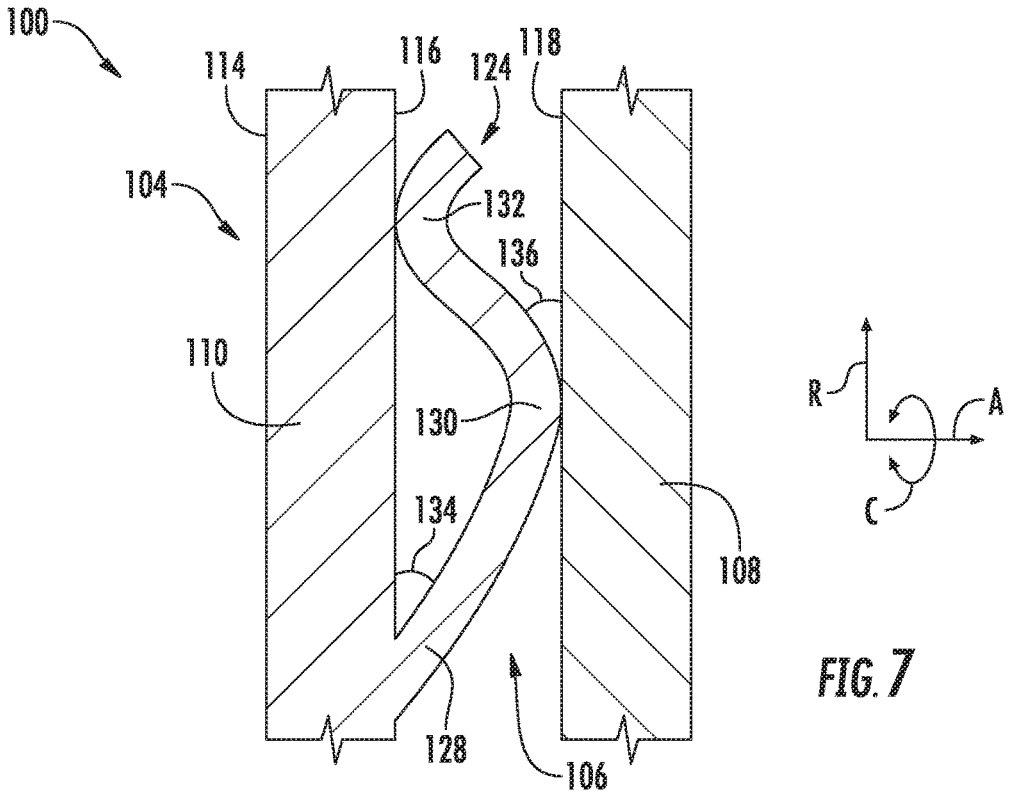

Referring particularly to FIGS. 5 and 6, the insert 104 includes an insert body 110 that defines an insert cavity 112 therein. In the embodiment illustrated in FIGS. 5 and 6, the insert body 110 has an annular cross-section. As such, the insert body 110 includes an inner surface 114, which forms the outer boundary of the insert cavity 112, and an outer surface 116 spaced apart from the inner surface 114. Although, the insert body 110 may be plate-like or have any suitable shape in other embodiments.

As mentioned above, the insert 104 is positioned in the turbomachine component cavity 106 of the turbomachine component 108. More specifically, an inner surface 118 of the turbomachine component 108 forms the outer boundary of the turbomachine component cavity 106. The insert 104 is positioned within the turbomachine component cavity 106 in such a manner that the outer surface 116 of the insert body 110 is spaced apart (e.g., axially spaced apart) from the inner surface 118 of the turbomachine component 108. The spacing between outer surface 116 of the insert body 110 and the inner surface 118 of the turbomachine component 108 may be sized to facilitate impingement cooling of the inner surface 114 of the turbomachine component 108.

As illustrated in FIGS. 5-6, the insert body 110 may define one or more impingement apertures 120. In particular, the impingement apertures 120 extend through the insert body 110 from the inner surface 114 thereof through the outer surface 116 thereof. The impingement apertures 120 provide fluid communication between the insert cavity 112 and the turbomachine component cavity 106. The impingement apertures 120 have a circular cross-section in the embodiment shown in FIGS. 5 and 6. Although, the impingement apertures 120 may have any suitable cross-section (e.g., rectangular, triangular, oval, elliptical, pentagonal, hexagonal, star-shaped, etc.). Furthermore, the impingement apertures 120 may be sized to provide impingement cooling to the inner surface 118 of the turbomachine component 108.

The impingement apertures 120 are arranged in linear rows 122 in the embodiment shown in FIGS. 5 and 6. The linear rows 122 of impingement apertures 120 may extend along substantially the entire radial length of the insert body 110 or only a portion thereof. The impingement apertures 120 may be arranged into any suitable number of linear rows 122. Nevertheless, the plurality of impingement apertures 120 may be arranged on the insert body 110 in any manner that facilitates impingement cooling of the inner the inner surface 118 of the turbomachine component 108.

Referring particularly to FIG. 6, the insert 104 also includes one or more spring bodies 124 extending outwardly (e.g., axially outwardly) from the outer surface 116 of the insert body 110. In the embodiment shown in FIG. 6, the spring bodies 124 are arranged in linear rows 126. The linear rows 126 of spring bodies 124 may extend along substantially the entire radial length of the insert body 110 or only a portion thereof. For example, one linear row 126 of spring bodies 124 is positioned between each adjacent pair of the linear rows 122 of impingement apertures 120 in the embodiment shown in FIG. 6. Nevertheless, the spring bodies 124 may be arranged in any suitable number of linear rows 126. Furthermore, the spring bodies 124 may be arranged on the insert body 110 in any suitable manner.

As illustrated in FIG. 7, the spring bodies 124 are in contact with the outer surface 116 of the insert body 110 and the inner surface 118 of the turbomachine component 108. In this respect, the spring bodies 124 may conduct heat from the turbomachine component 108 to the insert body 110. More specifically, the spring body 124 includes a first portion 128 fixedly coupled to the outer surface 116 of the insert body 110. The spring body 124 also includes a second portion 130 in sliding engagement with the inner surface 118 of the turbomachine component 108. Furthermore, the spring body 124 includes a third portion 132 in sliding engagement with the outer surface 116 of the insert body 110.

FIG. 7 illustrates an exemplary embodiment of an arrangement of the various portions 128, 130, 132 of the spring body 124. As shown, the spring body 124 may extend outward (e.g., axially outward) and upward (e.g., radially upward) from the first portion 128 toward the second portion 130. The spring body 124 may then extend inward (e.g., axially inward) and upward (e.g., radially upward) from the second portion 130 to the third portion 132. In this respect, the second portion 130 of the spring body 124 may be positioned radially between the first portion 128 of the spring body 124 and the third portion 132 of the spring body 124. In some embodiments, the second portion 130 of the spring body 124 is positioned radially closer to the third portion 132 of the spring body 124 than to the first portion 128 of the spring body 124. As shown, at least a portion of the spring body 124 may be arcuate. In alternate embodiments, however, the first, second, and third portions 128, 130, 132 may be arranged in any suitable manner.

As shown in FIGS. 6 and 7, the spring body 124 is positioned on the insert body 110 such that it is oriented in the entirely radial direction R. In alternate embodiments, the spring body 124 may be arranged such that it is oriented entirely in the axial direction A or some angle relative to the axial and radial directions A, R.

The spring bodies 124 may have any suitable cross-section and/or shape. For example, the spring bodies 124 may have a circular cross-section, a rectangular cross-section, or an elliptical cross-section. The spring bodies 124 may have a constant thickness/diameter as the spring bodies 124 along the length thereof. Alternately, the spring bodies 124 may be tapered (i.e., narrower at the third portion 132 than the first portion 128).

Referring still to FIGS. 6 and 7, the spring bodies 124 may be non-perforated. That is, the spring bodies 124 may be devoid of apertures, passages, channels, holes, or other types of perforations.

Figure 8:
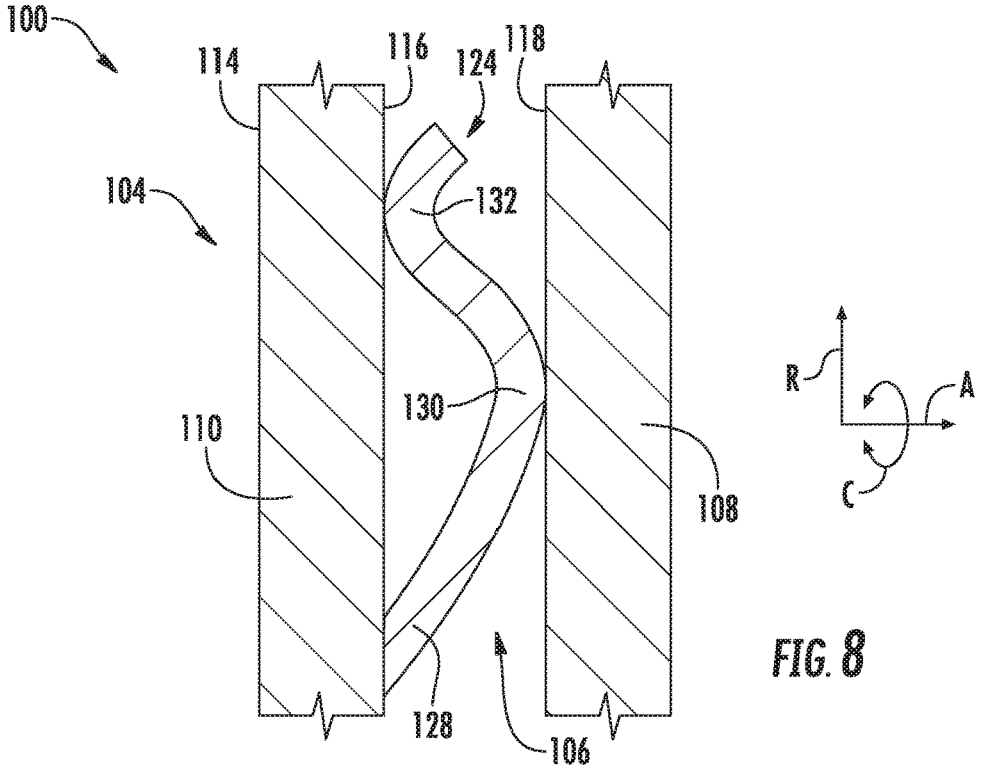
FIG. 8 is a cross-sectional view of another embodiment of a spring body in accordance with embodiments of the present disclosure.

As mentioned above, the first portion 128 of the spring body 124 is fixedly coupled to the insert body 110. In some embodiments, the first portion 128 of the spring body 124 may be integrally formed with the insert body 110 as shown in FIG. 7. In alternate embodiments, however, the first end 128 of the spring body 124 may be formed separately from the insert body 110 and then welded or brazed thereto as shown in FIG. 8.

In certain embodiments, the insert 104 may be formed via additive manufacturing methods. The term "additive manufacturing" as used herein refers to any process which results in a useful, three-dimensional object and includes a step of sequentially forming the shape of the object one layer at a time. Additive manufacturing processes include three-dimensional printing (3DP) processes, laser-net-shape manufacturing, direct metal laser sintering (DMLS), direct metal laser melting (DMLM), plasma transferred arc, freeform fabrication, etc. A particular type of additive manufacturing process uses an energy beam, for example, an electron beam or electromagnetic radiation such as a laser beam, to sinter or melt a powder material. Additive manufacturing processes typically employ metal powder materials or wire as a raw material. Nevertheless, the insert 104 may be constructed using any suitable manufacturing process.

As mentioned above, the spring body 124 may extend upwardly and outwardly from the first portion 128 to the second portion 130. Similarly, the spring body 124 may extend upwardly and inwardly from the second portion 130 to the third portion 132. In this respect, each portion 128, 130, 132 may extend away from the insert body 110 in an upwardly oriented manner. As such, the first portion 128 defines a first angle 134 relative to the insert body 110, and the second portion 130 defines a second angle 136 relative to the turbomachine component 108. The first and second angles 134, 136 provide the support necessary to form the spring bodies 124 using additive manufacturing processes. In some embodiments, the first and second angles 134, 136 may be between thirty degrees and sixty degrees. In alternate embodiments, however, the spring bodies 124 may extend be oriented at any suitable angle relative to the insert body 110 and/or the turbomachine component 108.

As mentioned above, the insert 104 is inserted into the turbomachine component cavity 106. More specifically, the orientation and inherent flexibility of the spring bodies 124 may permit insertion of the insert 104 into the turbomachine component cavity 106. As the insert 104 enters the turbomachine component cavity 106, the second and third portions 130, 132 of the spring bodies 124 respectively slide along the outer surface 116 of the insert body 110 and the inner surface 118 of the turbomachine component 108. This sliding movement permits the spring body 124 to compress (i.e., flex in the axial and radial directions A, R). This compression removably retains the insert 104 within the turbomachine component cavity 106.

The spring bodies 124 also retain the insert body 110 within the turbomachine component cavity 106. Specifically, the spring bodies 124 exert forces on the turbomachine component 108 that hold the insert body 110 in place. The spring bodies 124 also maintain the gap between the insert body 110 and the turbomachine component 108 to facilitate impingement cooling as described above. In this respect, some or all of the spring bodies 124 should be sized to have sufficient structural strength to hold the insert body 110 in place and prevent the insert body 110 from rattling or vibrating within the turbomachine component cavity 106.

Figure 9:
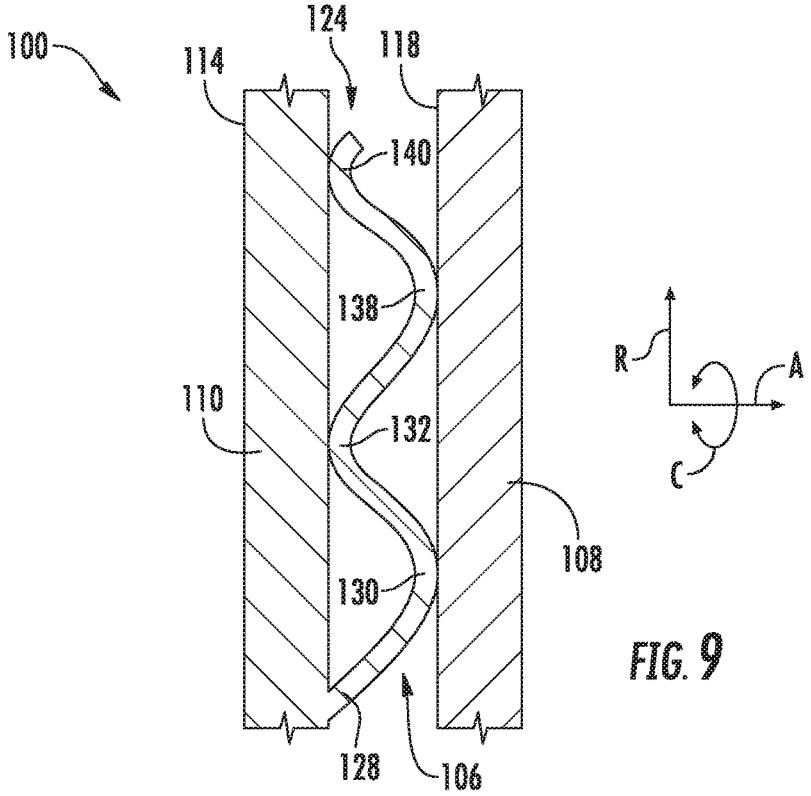
FIG. 9 is a cross-sectional view of a further embodiment of a spring body in accordance with embodiments of the present disclosure.

FIG. 9 illustrates an alternate embodiment of the spring body 124. As mentioned above, the spring body 124 includes the first portion 128 fixedly coupled to the insert body 110, the second portion 130 in sliding engagement with the turbomachine component 108, and the third portion 132 in sliding engagement with the insert body 110. The embodiment of the spring body 124 shown in FIG. 9 also includes a fourth portion 138 in sliding engagement with the inner surface 118 of the turbomachine component 108. The spring body 124 shown in FIG. 9 further includes a fifth portion 140 in sliding engagement with the outer surface 116 of the insert body 110. In this respect, the spring body 124 may be sinusoidal. In alternate embodiments, however, the spring body 124 may have any suitable number of portions in sliding engagement with the insert body 110 and/or the turbomachine component 108.

In operation, the insert 104 provides convective and conductive cooling to the turbomachine component 108. More specifically, cooling air (e.g., a portion of the compressed air 38) flows radially through the insert cavity 112. The impingement apertures 120 direct a portion of the cooling air flowing through the insert 104 onto the inner surface 118 of the turbomachine component 108. That is, the cooling air flows through the impingement apertures 120 and the turbomachine component cavity 106 until striking the inner surface 118 of the turbomachine component 108. As such, impingement apertures 120 provide convective cooling (i.e., impingement cooling) to the turbomachine component 108. The spring bodies 124 also disturb the air within the turbomachine component cavity 106, further increasing the rate of convective heat transfer. As mentioned above, the spring bodies 124 contact both the outer surface 116 of the insert body 110 and the inner surface 118 of the turbomachine component 108. In this respect, heat may conduct from the turbomachine component 108 through the spring bodies 124 to the insert body 110. The cooling air flowing through the insert cavity 112 may absorb the heat conductively transferred to the insert body 110 by the spring bodies 124.

As discussed in greater detail above, the impingement apertures 120 convectively cool the turbomachine component 108, and the spring bodies 124 conductively cool the turbomachine component 108. Since the insert 104 provides both convective and conductive cooling to the turbomachine component 108, the insert 104 provides greater cooling to the turbomachine component 108 than conventional inserts. As such, the insert 104 may define fewer impingement apertures 120 than conventional inserts. Accordingly, the insert 104 diverts less compressed air 38 from the compressor section 12 (FIG. 1) than conventional inserts, thereby increasing the efficiency of the gas turbine engine 10.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A cooling system for a turbomachine, comprising:

a turbomachine component defining a turbomachine component cavity; and an insert positioned within the turbomachine component cavity for cooling the turbomachine component, the insert extending along a radial direction between a first end of the insert and a second end of the insert, the insert comprising:

an insert body; and a spring body for conducting heat from the turbomachine component to the insert body, the spring body including a first portion fixedly coupled to the insert body, a second portion in sliding engagement with the turbomachine component, and a third portion in sliding engagement with the insert body, the third portion spaced apart from the first portion in the radial direction.

2. The system of claim 1, wherein the spring body is non-perforated.

3. The system of claim 1, wherein second portion of the spring body is positioned between the first portion of the spring body and the third portion of the spring body.

4. The system of claim 3, wherein a radial distance between the second portion of the spring body and the first portion of the spring body is greater than a radial distance between the third portion of the spring body and the second portion of the spring body.

5. The system of claim 1, wherein the first portion of the spring body is integrally coupled to the insert body.

6. The system of claim 1, wherein at least a portion of the spring body is arcuate.

7. The system of claim 1, wherein the spring body comprises a fourth portion in sliding engagement with the turbomachine component and a fifth portion in sliding engagement with the insert body.

8. The system of claim 7, wherein the spring body is sinusoidal.

9. The system of claim 1, wherein the insert comprises a plurality of spring bodies arranged in one or more radially-extending rows.

10. The system of claim 1, wherein the insert body defines an insert body cavity and an impingement aperture fluidly coupling the insert body cavity and the turbomachine component cavity.

11. A turbomachine, comprising:

a turbine section, comprising:

a turbine section component defining a turbine section component cavity; and an insert positioned within the turbine section component cavity for cooling the turbine section component, the insert extending along a radial direction between a first end of the insert and a second end of the insert, the insert comprising:

an insert body; and a spring body for conducting heat from the turbomachine component to the insert body, the spring body including a first portion fixedly coupled to the insert body, a second portion in sliding engagement with the turbine section component, and a third portion in sliding engagement with the insert body, the third portion spaced apart from the first portion in the radial direction.

12. The turbomachine of claim 11, wherein the spring body is non-perforated.

13. The turbomachine of claim 11, wherein second portion of the spring body is positioned between the first portion of the spring body and the third portion of the spring body.

14. The turbomachine of claim 13 wherein a radial distance between the second portion of the spring body and the first portion of the spring body is greater than a radial distance between the third portion of the spring body and the second portion of the spring body.

15. The turbomachine of claim 11, wherein the first portion of the spring body is integrally coupled to the insert body.

16. The turbomachine of claim 11, wherein at least a portion of the spring body is arcuate.

17. The turbomachine of claim 11, wherein the spring body comprises a fourth portion in sliding engagement with the turbine section component and a fifth portion in sliding engagement with the insert body.

18. The turbomachine of claim 17, wherein the spring body is sinusoidal.

19. The turbomachine of claim 11, wherein the insert comprises a plurality of spring bodies arranged in one or more radially-extending rows.

20. A cooling system for a turbomachine, comprising:

a turbomachine component defining a turbomachine component cavity; and an insert positioned within the turbomachine component cavity for cooling the turbomachine component, the insert extending along a radial direction between a first end of the insert and a second end of the insert, the insert comprising:

an insert body; and a spring body for conducting heat from the turbomachine component to the insert body, the spring body including a first portion integrally coupled to the insert body, a second portion in sliding engagement with the turbomachine component, and a third portion in sliding engagement with the insert body, the third portion spaced apart from the first portion in the radial direction.

* * * * *